US009038872B1

(12) United States Patent
Chang

(10) Patent No.: US 9,038,872 B1
(45) Date of Patent: May 26, 2015

(54) STRAPS FOR CARRYING AN OBJECT

(76) Inventor: Shun-Hwa Chang, Fremont, CA (US)

( * ) Notice: Subject to any disclaimer, the term of this patent is extended or adjusted under 35 U.S.C. 154(b) by 1422 days.

(21) Appl. No.: 12/415,974

(22) Filed: Mar. 31, 2009

Related U.S. Application Data

(63) Continuation-in-part of application No. 11/829,905, filed on Jul. 28, 2007, now abandoned.

(51) Int. Cl.
*A45F 3/14* (2006.01)
*A45F 5/00* (2006.01)
*G10G 5/00* (2006.01)

(52) U.S. Cl.
CPC ..... *A45F 5/00* (2013.01); *Y10S 224/909* (2013.01); *A45F 2003/142* (2013.01); *G10G 5/005* (2013.01); *Y10S 224/908* (2013.01); *Y10S 224/91* (2013.01)

(58) Field of Classification Search
USPC ..... 224/264, 265, 651, 257
See application file for complete search history.

(56) References Cited

U.S. PATENT DOCUMENTS

| | | | | | |
|---|---|---|---|---|---|
| 1,665,745 | A | * | 4/1928 | Lang | 224/258 |
| 2,100,088 | A | * | 11/1937 | Robertson | 224/258 |
| 2,247,867 | A | * | 7/1941 | Baumann | 224/258 |
| 2,630,255 | A | * | 3/1953 | Finder | 224/258 |
| 3,130,441 | A | * | 4/1964 | Hahn | 401/201 |
| 3,554,194 | A | * | 1/1971 | Johnson | 602/4 |
| 3,602,409 | A | * | 8/1971 | Kerns | 224/258 |
| 3,883,053 | A | | 5/1975 | Pritchard et al. | |
| 3,959,841 | A | * | 6/1976 | Horne | 15/104.94 |
| 3,977,796 | A | * | 8/1976 | Gillespie et al. | 401/8 |
| 4,870,705 | A | * | 10/1989 | Higby et al. | 2/468 |
| 5,065,919 | A | * | 11/1991 | Sims | 224/257 |
| 5,151,778 | A | * | 9/1992 | Conley | 351/156 |
| 5,211,623 | A | * | 5/1993 | Sarkozi | 602/18 |
| 5,295,949 | A | * | 3/1994 | Hathaway | 602/18 |
| 5,498,218 | A | * | 3/1996 | Proctor et al. | 482/10 |
| 5,753,839 | A | * | 5/1998 | McFarlin | 84/387 A |
| D412,365 | S | * | 7/1999 | Szabo | D24/214 |
| 6,227,742 | B1 | * | 5/2001 | Corn et al. | 401/201 |
| 6,748,615 | B1 | * | 6/2004 | Tiedemann | 5/640 |

(Continued)

FOREIGN PATENT DOCUMENTS

JP 2004329731 A 11/2004

OTHER PUBLICATIONS

USPTO—Office Action Mailed on Apr. 30, 2010 (U.S. Appl. No. 11/829,905).

(Continued)

*Primary Examiner* — Justin Larson
*Assistant Examiner* — Lester L Vanterpool
(74) *Attorney, Agent, or Firm* — Roger H. Chu

(57) ABSTRACT

A carrying strap for supporting an object is described. According to an exemplary embodiment of the present invention, the carrying strap comprises a neck pad for distributing the object's weight over the user's neck, the neck pad having inner or first, and outer or second sides affixed to each other along perimeter, wherein the first side is configured to contact backside of the user's neck and the first side comprises two partially overlapped layers in a mirror-image orientation to form an open slot, located substantially near center portion of the neck pad, which is configured for housing a removable cushion that provides extra cushion to the backside of the user's neck; at least one hook for securing the object; and an extension portion connecting the neck pad and the at least one hook.

15 Claims, 12 Drawing Sheets

(56) References Cited

U.S. PATENT DOCUMENTS

| | | | | |
|---|---|---|---|---|
| 6,849,055 | B1 * | 2/2005 | Williams | 601/137 |
| 7,004,363 | B2 | 2/2006 | Fenton et al. | |
| 2005/0154335 | A1 * | 7/2005 | Wang | 601/137 |
| 2006/0010657 | A1 * | 1/2006 | Warren et al. | 24/3.1 |
| 2006/0065683 | A1 * | 3/2006 | Armstrong | 224/264 |
| 2006/0241537 | A1 | 10/2006 | Liu | |

OTHER PUBLICATIONS

Response to the Apr. 30, 2010 Office Action (U.S. Appl. No. 11/829,905)—Jul. 15, 2010.

USPTO—Office Action Mailed on Sep. 14, 2010 (U.S. Appl. No. 11/829,905).

* cited by examiner

STRAPS FOR CARRYING AN OBJECT

CROSS REFERENCE TO RELATED APPLICATIONS

This application is a continuation-in-part of a co-pending U.S. patent application Ser. No. 11/829,905 for "Improved Strap for Music instruments", filed on Jul. 28, 2007.

FIELD OF THE INVENTION

The present invention generally relates to straps, and more particularly to straps or holders for holding or carrying a weighty object such as a music instrument (e.g., saxophone, guitar, etc.), a camera over the neck of a user.

BACKGROUND OF THE INVENTION

Music instruments such as saxophone are generally supported by a strap over the neck of a musician or a player while being played. The player needs to endure the weight for the duration of a prolonged playing time (e.g., sometime over several hours or more) in a practice or performance. This could leads to discomfort, pain, and/or fatigue of the player thereby losing concentration and performance.

Attempting to solve this problem, prior art approaches include generally adding a wider pad or patch on the strap such that the pad or patch can cover wider area of the neck and the back of the player. However, due to anatomy of the spinal structure in the neck area, the player often experiences a lot of discomforts right over the spinal area of the back of the neck even with wider pad. Further, blood flow in the neck arteries and/or veins (e.g., external carotid artery and/or internal jugular) would be reduced from the pressure through prior art straps.

Therefore, it would be desirable to have an improved support strap that can support the weight of music instruments comfortably over the neck of a player while playing. Furthermore, it would be desirable to have the improved strap to be used for carrying any weigh objects such as camera, or user's own injured arm.

SUMMARY OF THE INVENTION

This section is for the purpose of summarizing some aspects of the present invention and to briefly introduce some preferred embodiments. Simplifications or omissions in this section as well as in the abstract and the title herein may be made to avoid obscuring the purpose of the section. Such simplifications or omissions are not intended to limit the scope of the present invention.

An improved carrying strap for music instruments is disclosed. According to an exemplary embodiment of the present invention, the strap comprises a neck pad, at least one hook (e.g., swivel hook, open hook), and an extension portion (e.g., slightly elastic loop or strip) connecting the neck pad and the hook. The strap is configured to form a loop to hang or support the music instrument over the head and around the neck of the player. The neck pad is made of two sides. A first or inner side (the side contacting the backside of the player or user's neck) is made of moisture absorbing material (e.g., cotton, silk), while the second or outer side is made of sturdy material such as leather or nylon lined. Soft padding materials are generally sandwiched between the first and second sides. Additionally, the neck pad includes an extra cushion portion, which is located in substantially middle of the neck pad configured to provide an extra cushion around the spinal area in the backside of the neck. The extra cushion portion includes an open slot in the neck pad and a removable cushion of soft material (e.g., sponge, cotton, rubber, etc.), which is inserted into the open slot.

According to another aspect, the inner side comprises a pair of overlapping layers to form the open slot of the extra cushion portion by sewing the outer and the inner sides together in the perimeter such that the overlapped region is left open for housing the removable cushion. The pair of overlapping layers is configured in a mirror-image orientation and assembled together to form the inner side. The open slot is orientated across shorter dimension of the neck pad. The outer side has the same shape as the assembled inner side.

According to yet another aspect, the removable cushion of the extra cushion portion is made of various sizes and shapes. In one embodiment, the removable cushion is made of a sheet of rubber rolled up to a cylindrical shaped. The removable cushion is so dimensioned to be inserted into the open slot in an arbitrary orientation based upon preference of the player or user of the strap.

According yet another aspect of the present invention, a neck pad is made of shape-able material to form the neck pad as if a soft roll had been inserted in the open slot. In still another aspect, the neck pad is inflatable not only to provide the added padding at the spinal area, but to form a contour substantially similar to the shape for the back of the neck of the player. Based on personal preference, the amount of the fluids pumped in the inflatable neck pad can be adjusted accordingly.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will be better understood with regard to the following description, appended claims, and accompanying drawings as follows:

DETAILED DESCRIPTION

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Used herein, the terms "outer", "inner", "horizontal", "vertical", "top", "bottom", "front", "back", "rear", "side", "middle", "upwards", and "downwards" are intended to provide relative positions for the purposes of description, and are not intended to designate an absolute frame of reference.

Embodiments of the present invention are discussed herein with reference to FIGS. 1A-7D. However, those skilled in the art will readily understand and appreciate that the detailed descriptions given herein with respect to these figures is for explanatory purposes as the invention extends beyond these limited embodiments.

Figure 1A:
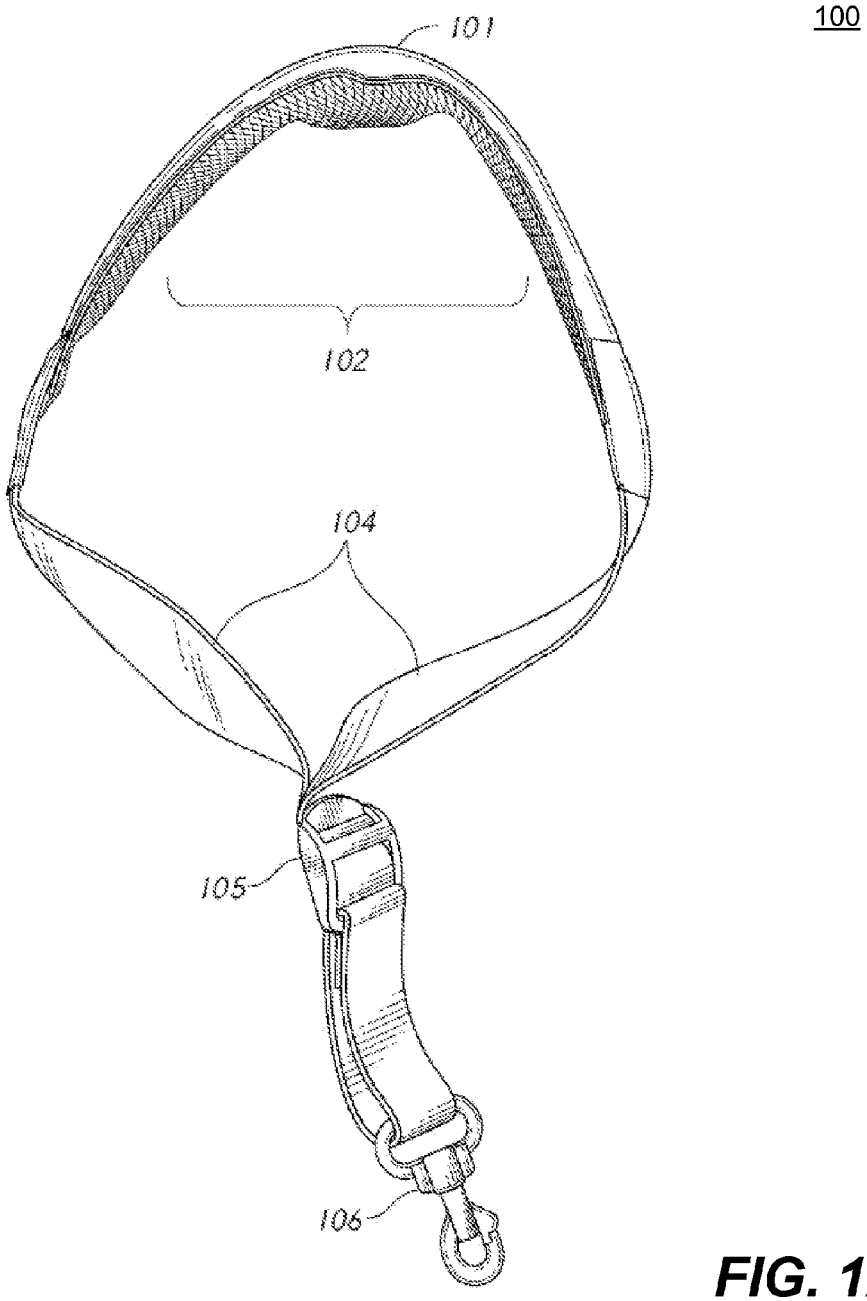
FIG. 1A is a perspective view for showing an exemplary improved support strap with an extra cushion portion for music instruments, according to an embodiment of the present invention.
Figure 1B:
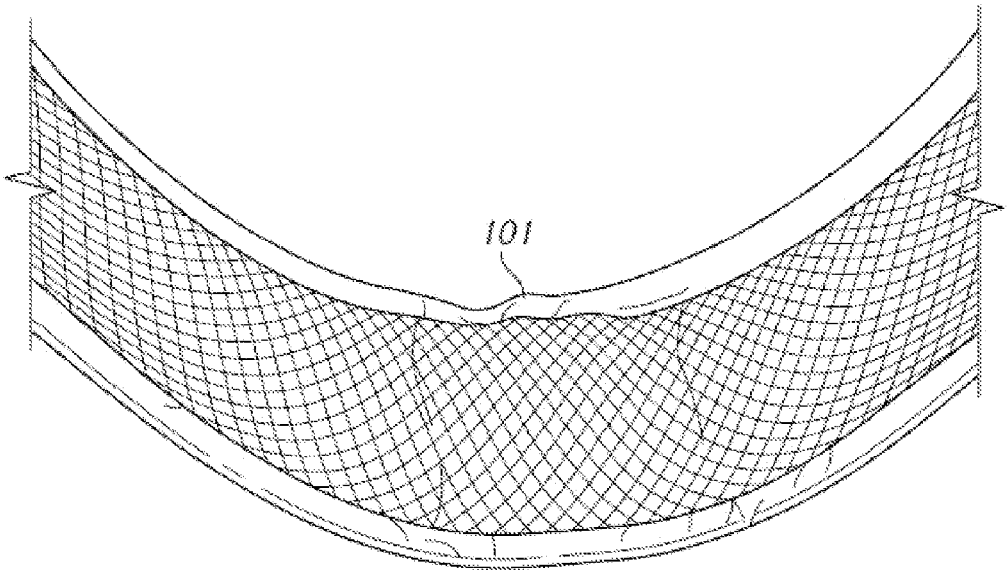
FIG. 1B is an enlarged view of the extra cushion portion of the support strap of FIG. 1A.

Referring now to the drawings, in which like numerals refer to like parts throughout the several views. FIG. 1A shows an exemplary improved support strap 100 in accordance with one embodiment of the present invention. The strap comprises a neck pad 102 with an extra cushion portion 101, a hook 106 (e.g., swivel hook, open hook), and an extension portion 104 including an adjustable buckle 105. The extension portion 104 (e.g., slightly elastic loop or strips) connects the neck pad 102 to the hook 106 to form a loop to hang or support the music instrument over the head and around the neck of a player.

The neck pad 102 is made of sturdy material such as leather or nylon lined with a layer of moisture absorbing material (e.g., cotton, silk) in the side contacting the neck of the player. The neck pad 102 includes an extra cushion portion 101, as shown in an enlarged view in FIG. 1B, which is located in substantially middle of the neck pad 102 in contact with the spinal area of the neck. The extra cushion portion 101 may be provided as an additional pad right around the back of spine. The extra cushion portion 101 ensures a better contact between the neck pad 102 and the back of the player's neck; thus provides additional padding to spread the weight of music instruments to a larger area. In additional, blood flow in the arteries and veins along the player's neck is not constricted as much because the extra cushion portion 101 adds stiffness to the neck pad 102. The stiffer the neck pad 102 is, the more the neck pad 102 may hold its form. As a result, the neck pad 102 does not put a direct pressure on the neck arteries and veins. All of the above reasons is derived from a discovery that the extra cushion portion 101 in the neck pad 102 of the improved support strap 100, according to an embodiment of the present invention, allows a player to play a music instrument (e.g., saxophone) much more comfortably for much longer time.

Figure 2A:
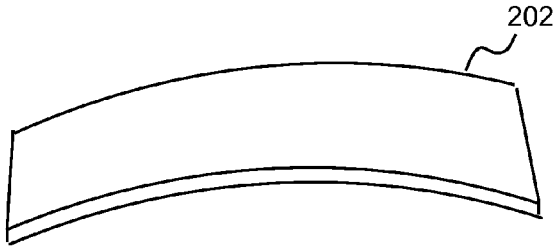
FIG. 2A (Prior Art)
FIG. 2A is a perspective view of a neck pad in a prior art support strap.
Figure 2B:
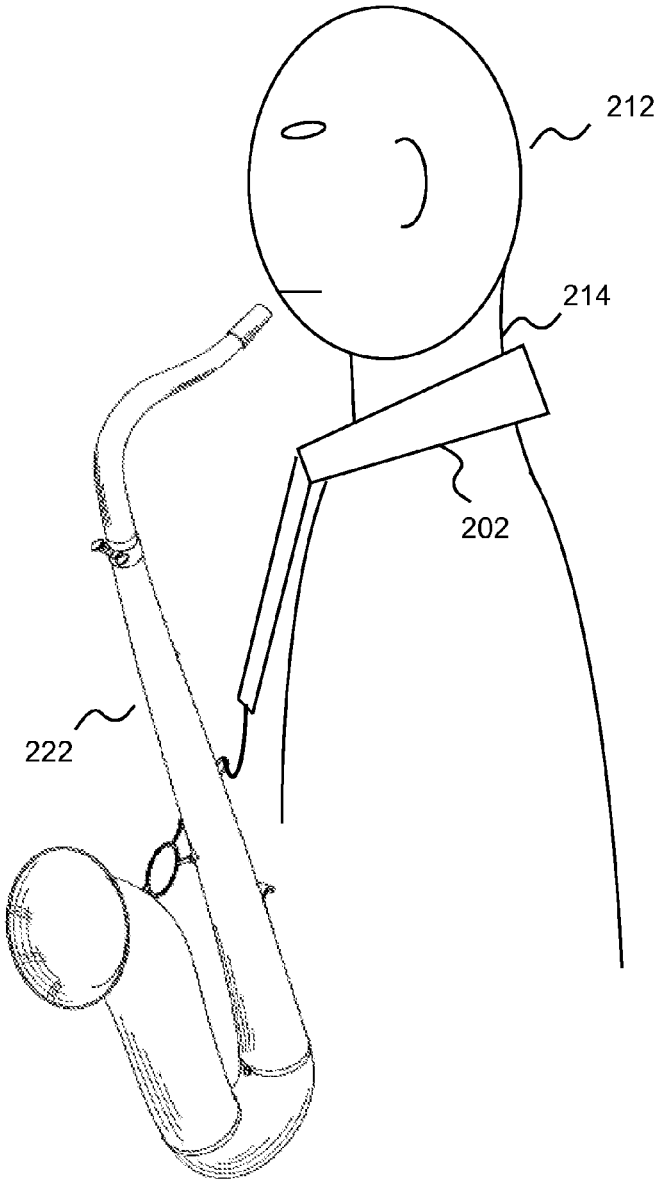
FIG. 2B (Prior Art)
FIG. 2B is a side view of the support strap of FIG. 2A in use by a player to support a saxophone.

FIG. 2A shows a neck pad 202 of a prior art music instrument support strap. As clearly can be seen in FIG. 2, the neck pad 202 has a uniform thickness across the entire pad. The prior art neck pad 202 would conform to the neck 214 of a player 212 as shown in FIG. 2B, when the player 212 plays a music instrument (e.g., saxophone 222).

Figure 3A:
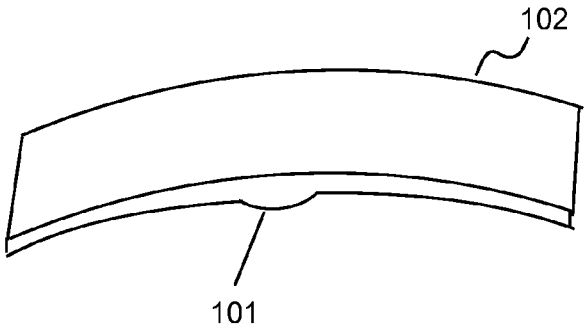
FIG. 3A is a perspective view of a neck pad in an exemplary improved support strap in accordance with one embodiment of the present invention.
Figure 3B:
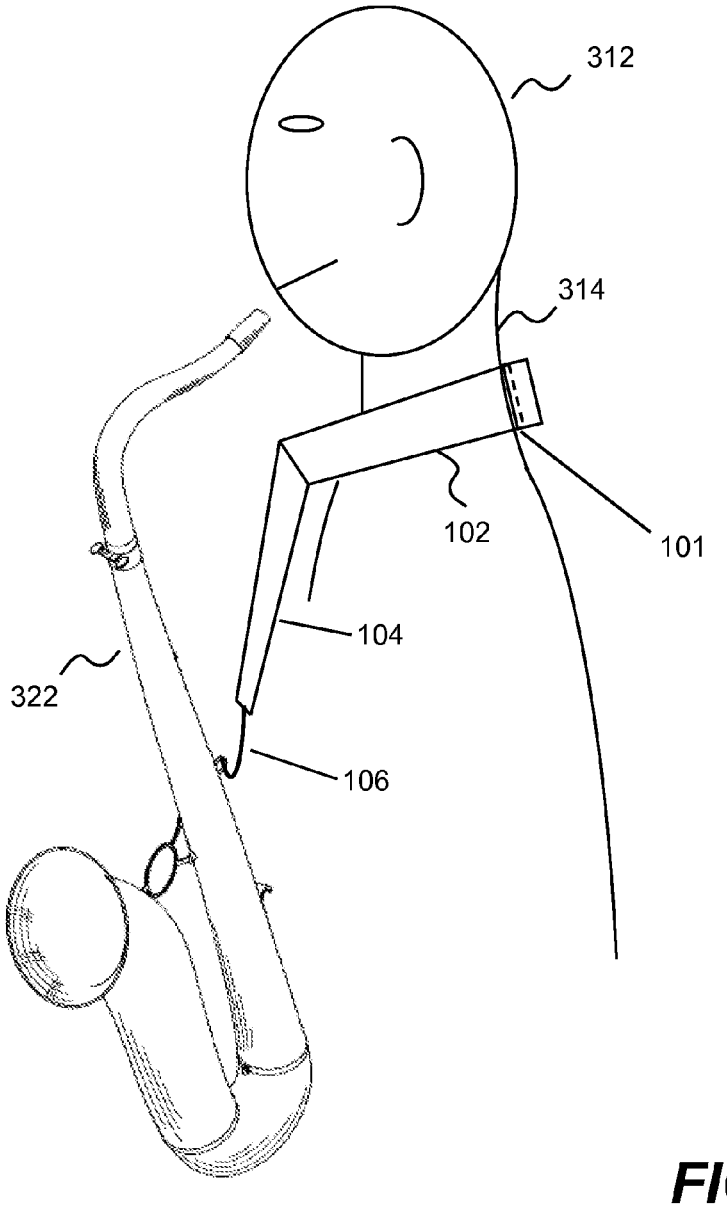
FIG. 3B is a side view of the improved support strap of FIG. 3A in use by a player to support a saxophone in accordance with one embodiment of the present invention.

FIG. 3A is a perspective view showing the neck pad 102 with the extra cushion portion 101 of the exemplary improved support strap 100 of FIG. 1A in accordance with one embodiment of the present invention. FIG. 3B shows that a player 312 plays a saxophone 322 using the exemplary support strap 100. The extra cushion portion 101 of the exemplary support strap 100 fits the back side 314 (i.e., spinal area) of the player's neck.

Figure 4A:
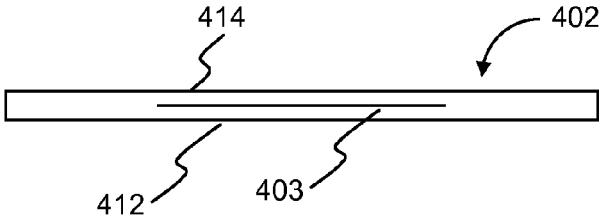
FIGS. 4A-4D are various views showing different configurations of a neck pad with an open slot inserted with a roll of soft material in accordance with another embodiment of the present invention.
Figure 4B:
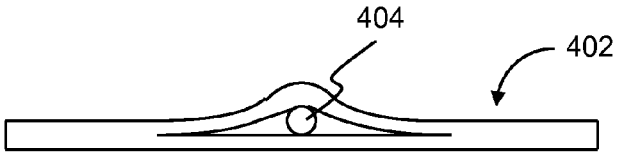
Figure 4C:
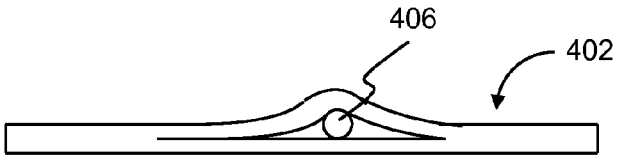
Figure 4D:
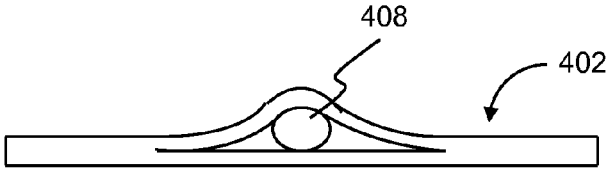

In another embodiment of the present invention, the extra cushion portion is formed by inserting a soft roll (e.g., roll 404, 406 or 408) into an open slot 403 of a neck pad 402 as shown in FIGS. 4A-4D. The open slot 403 is sandwiched between an outside layer 412 and an inner layer 414. The inner layer 414 directly contacts with the neck of the player. Generally the inner layer 414 is made of materials that can absorb moistures such as the player's sweats. The outer layer 412 is made of sturdy material so that the weight of music instruments can be supported. With the open slot 403, the soft roll may be inserted in different locations (i.e., preferred location of the player). For example, while a roll 404 is inserted and located at a substantially middle of the neck pad 402, another roll 406 is located off center as shown in FIG. 4C. In another configuration as shown in FIG. 4D, a larger roll 408 is used.

Figure 5:
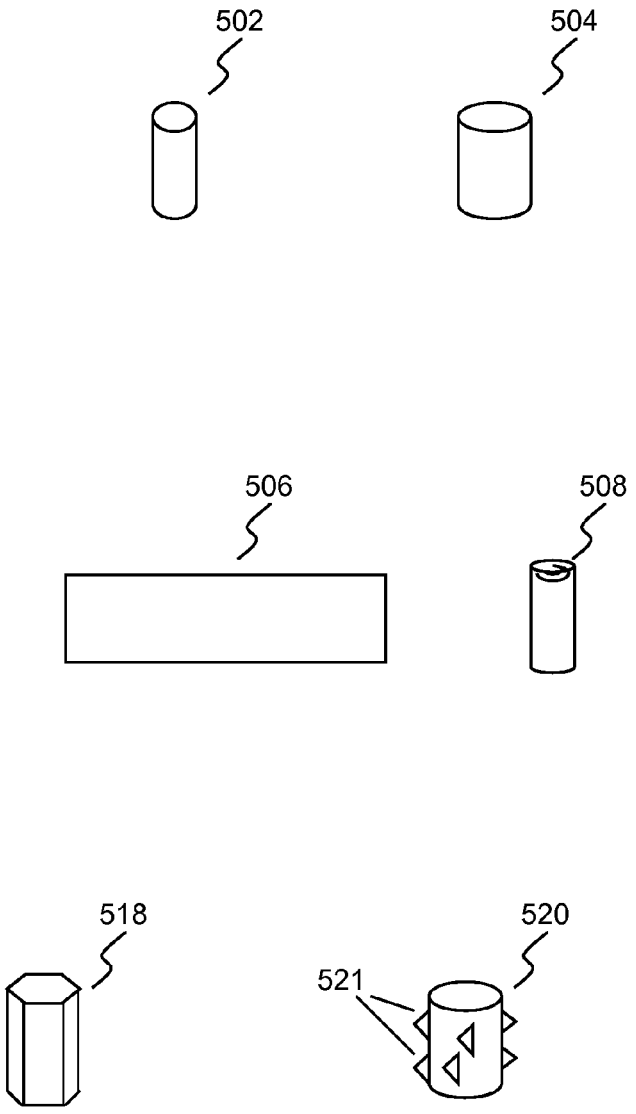
FIG. 5 shows a variety of removable cushions that can be inserted into the neck pad of FIG. 4A for forming the improved support strap, according to an embodiment of the present invention.

In fact, there is no limitation as to the locations and the sizes of the roll to be used in the present invention. FIG. 5 shows a variety of soft rolls that can be used in the present invention including but not necessarily limited to, a small cylindrical roll 502, a larger cylindrical roll 504, a rolled-up roll 508 that is made of from a rectangular soft material (e.g., cloth, paper), and a hexagonal roll 518. Other types of rolls may include a roll 520 covered with semi-rigid stimulating spiky protrusions 521 suitable for massaging the back of the player's neck.

Figure 6:
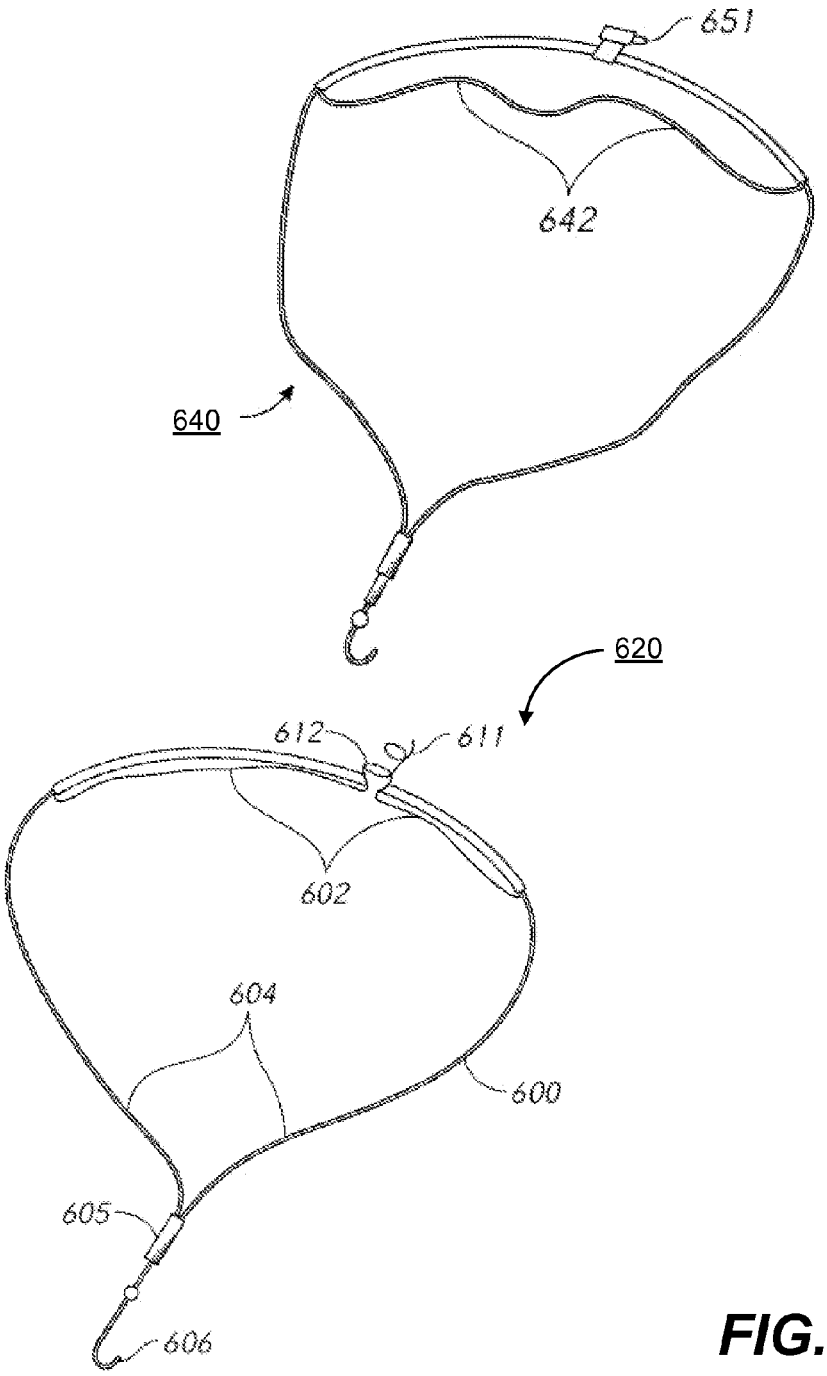
FIG. 6 shows perspective views of two configurations of an exemplary improved support strap with inflatable neck pad, according to an embodiment of the present invention.

FIG. 6 shows perspective view of two configurations of an exemplary improved support strap 600 with inflatable neck pad in accordance with one embodiment of the present invention. The perspective view of the first configuration 620 shows the support strap 600 with the neck pad 602 in an un-inflated state. The neck pad 602 is configured with a valve 612 (e.g., a one-way valve) for allowing fluids (i.e., air or water) to be let in (e.g., pump in, blow in, etc.). In the first configuration 620, the valve cap 611 is in an open position thereby the neck pad 602 is un-inflated. Other components comprised in the strap 600 include a hook 606, an adjustable buckle 605 and a pair of elastic extension portions that connect the neck pad 602 and the hook 606. The perspective view of a second configuration 640 shows the neck pad 642 is inflated with the valve cap 651 in a closed position. The inflated neck pad 642 provides extra cushion and fits the shape of a player's neck.

Figure 7A:
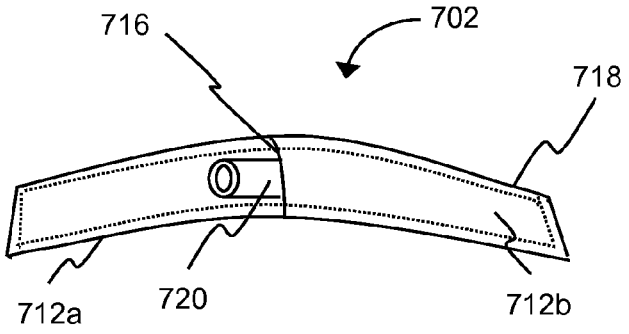
FIG. 7A and FIG. 7B are perspective views showing first and second sides (i.e., inner and outer sides) of an exemplary neck pad with an open slot formed by two overlapping layers of the inner side (i.e., the side contacting backside of the user's neck), according to an embodiment of the present invention.
Figure 7B:
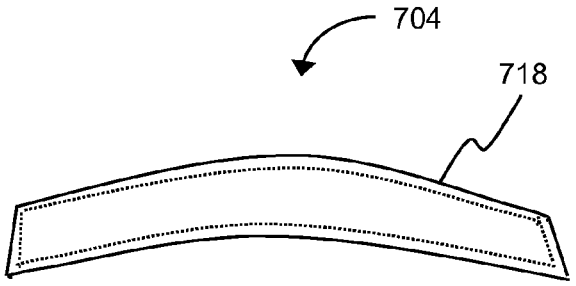
Figure 7C:
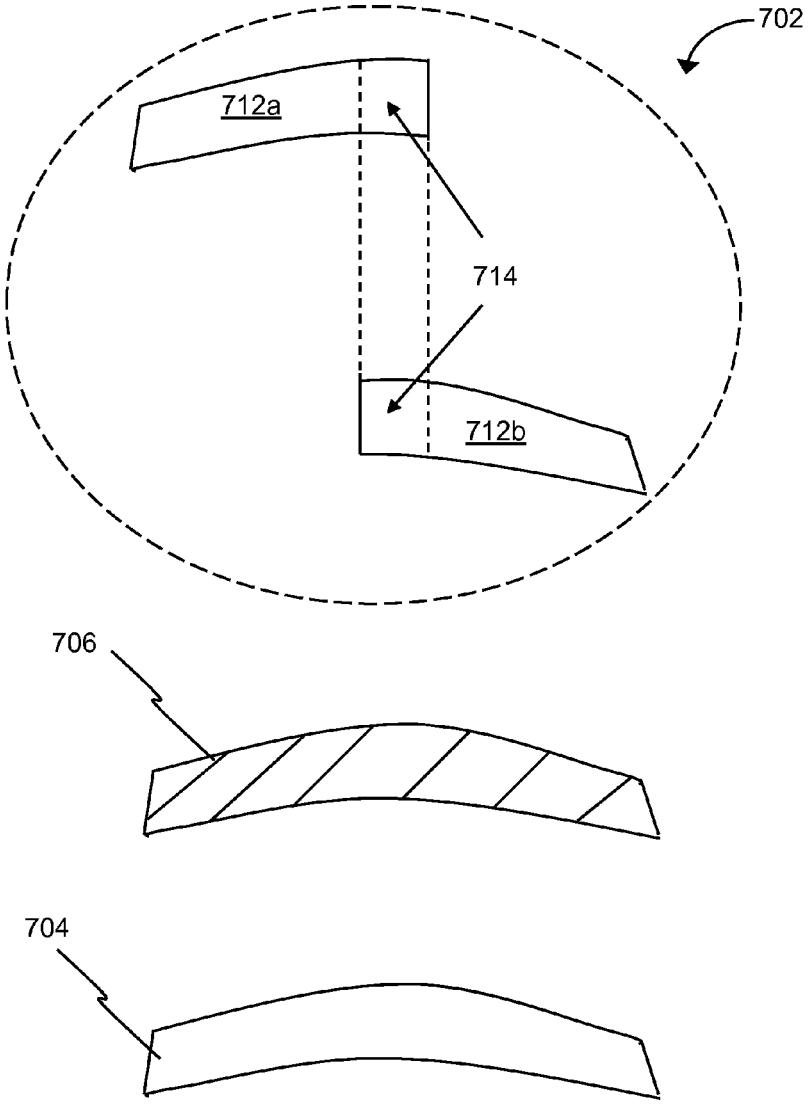
FIG. 7C is a diagram showing salient components of the neck pad shown in FIG. 7A-B.
Figure 7D:
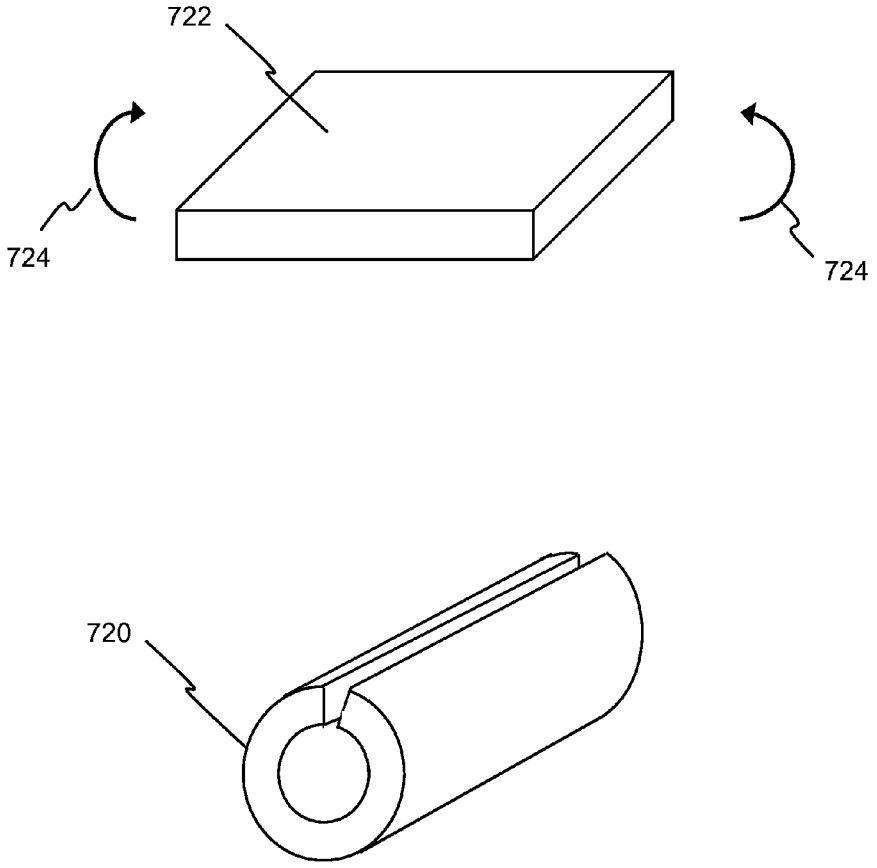
FIG. 7D is a diagram showing an exemplary removable cushion that can be inserted into the open slot of the neck pad shown in FIGS. 7A-B.

According to another embodiment, an exemplary neck pad is shown in FIGS. 7A-D. The neck pad can be used for replacing other neck pad described above. The neck pad comprises two sides—first or inner side 702, and second or outer side 704. FIG. 7A shows a perspective view of the inner side 702, which is the side configured for contacting the backside of the user's or player's neck. A perspective view of the outer side 704 is shown in FIG. 7B. FIG. 7C is a diagram showing salient components of the neck pad and FIG. 7D shows an exemplary removable cushion that can be used in conjunction with the neck pad.

The inner side 702 further comprises a pair of overlapping layers 712*a-b* to form an open slot 716, which is located in the overlapped region 714 (FIG. 7C) substantially near center or middle portion of the inner side 702. The open slot 716 is configured for housing a removable cushion 720 that provides extra cushion right around the spinal area of the backside of the user's neck. The removable cushion 720 can be inserted into and removed from the open slot 716 by the user based on preference. As an example, the removable cushion 720 can be inserted in a first orientation shown in FIG. 7A. The removable cushion 720 can also be inserted into the open slot 716 in other orientations, for example, a second orientation (not shown) that is 90-deg orthogonal to the first orientation providing the removable cushion in the second orientation can still be fit within the open slot 716.

The pair of layers of the inner side 702 is generally made of moisture absorbing materials, while the outer side 704 is made of more sturdy material such as leather, synthetic leather, etc. This is because the outer side 704 of the neck pad is configured for supporting majority of the weight of an object (e.g., a saxophone) to be carried. To form the neck pad, the inner side 702 and the outer side 704 are affixed to each other along the perimeter 718. In one embodiment, the affixation is accomplished by sewing. As shown in FIG. 7C, a pad made of soft material 706 is sandwiched between the inner and outer sides. The pad 706 is configured to be a soft cushion for the entire neck pad such that the weight of the object to be carried can be distributed to the entire contact area between the neck pad and the user.

According to one embodiment, the removable cushion 720 can be made by rolling a piece of soft material (e.g., rubber, synthetic rubber, etc.) 722 up into a cylindrical shape in a direction indicated by arrows 724 shown in FIG. 7D.

In FIGS. 7A-D, only an exemplary neck pad of a carrying strap is shown. Other portions or parts such as a hook and a pair of connecting strips are required to form a carrying strap, in accordance with one aspect of the present invention.

The present invention can be implemented in many ways, each of which may yield one or more of the following benefits, advantages or features. One of them is to allow a player to play music instrument such as saxophone more comfortably for a much longer time. Other benefits, advantages or features can be appreciated by those skilled in the art given the detailed description herein.

Although the present invention has been described with reference to specific embodiments thereof, these embodiments are merely illustrative, and not restrictive of, the present invention. Various modifications or changes to the specifically disclosed exemplary embodiments will be suggested to persons skilled in the art. For example, whereas the carrying strap has been shown and described to support the weight of a music instrument over a user's neck, the carrying strap may be used for supporting other objects, for example, a small package, a brief case, camera, etc. Also, the carrying strap may be used as an arm sling for injured arm. In summary, the scope of the invention should not be restricted to the specific exemplary embodiments disclosed herein, and all modifications that are readily suggested to those of ordinary skill in the art should be included within the spirit and purview of this application and scope of the appended claims.

What is claimed is:

1. A carrying strap for supporting an object over a user's neck comprising:

a neck pad for distributing the object's weight over the user's neck, said neck pad spanning over one side of the user's neck to another in said neck pad's longitudinal dimension, said neck pad having first and second sides affixed to each other along perimeter, the first side being configured to contact backside of the user's neck and the first side further including two partially overlapped layers in a mirror-image orientation to form a pocket with an open slot located substantially near center portion of the neck pad, said open slot being substantially perpendicular to said longitudinal dimension and said pocket being configured for housing a removable cushion that provides extra cushion to the backside of the user's neck;

at least one hook for securing the object; and an extension portion connecting said neck pad and said at least one hook.

2. The carrying strap of claim 1, wherein the object is a music instrument.

3. The carrying strap of claim 2, wherein the music instrument is a saxophone.

4. The carrying strap of claim 2, wherein the user is a player of the music instrument.

5. The carrying strap of claim 1, wherein the neck pad further comprises soft padding material sandwiched between the first and the second sides.

6. The carrying strap of claim 1, wherein the first and second sides are sewed together along the perimeter.

7. The carrying strap of claim 1, wherein the first side is made of moisture absorbing material configured to absorb the user's sweat.

8. The carrying strap of claim 7, wherein the second side is made of sturdy material configured to withstand substantial portion of the object's weight.

9. The carrying strap of claim 1, wherein the removable cushion is made of soft material that can be rolled up into a cylindrical shape.

10. The carrying strap of claim 1, wherein the removable cushion is so sized that the can be inserted through the open slot into the pocket in various orientations based on the user's preference.

11. The carrying strap of claim 10, wherein the removable cushion is configured to be interchangeable with another removable cushion of different shape.

12. The carrying strap of claim 1, wherein the removable cushion is configured for cushioning spinal area of the backside of the user's neck.

13. The carrying strap of claim 1, wherein the at least one hook is a swivel hook.

14. The carrying strap of claim 1, wherein the extension portion is formed by a pair of slightly elastic strips.

15. The carrying strap of claim 14, wherein each of the pair of strips connects to either end at the longitudinal dimension of the neck pad in one end, and the strips connecting to each other at other end through a connecting mechanism.

* * * * *